US007036663B2

(12) United States Patent
Itkonen et al.

(10) Patent No.: US 7,036,663 B2
(45) Date of Patent: May 2, 2006

(54) ROLL PACKAGE

(75) Inventors: Ismo Itkonen, Savonlinna (FI); Tapio Korhonen, Louhi (FI); Risto Laukkanen, Savonlinna (FI); Esa Nuutinen, Savonlinna (FI); Juha Pitkänen, Savonlinna (FI); Heikki Rasimus, Savonlinna (FI); Seppo Rasimus, Savonlinna (FI); Timo Silvennoinen, Savonlinna (FI); Veli Ulvinen, Savonlinna (FI)

(73) Assignee: Saimtec Engineering Oy, Savoulinna (FI)

( * ) Notice: Subject to any disclaimer, the term of this patent is extended or adjusted under 35 U.S.C. 154(b) by 0 days.

(21) Appl. No.: 10/979,434

(22) Filed: Nov. 2, 2004

(65) Prior Publication Data

US 2005/0061699 A1 Mar. 24, 2005

Related U.S. Application Data

(62) Division of application No. 09/933,892, filed on Aug. 21, 2001.

(30) Foreign Application Priority Data

Aug. 29, 2000 (FI) ..... 20001902

(51) Int. Cl.
*B65D 85/66* (2006.01)

(52) U.S. Cl. ..... 206/410; 206/413

(58) Field of Classification Search ..... 206/389, 206/401, 407, 410, 413; 53/441, 449, 399
See application file for complete search history.

(56) References Cited

U.S. PATENT DOCUMENTS

| | | | | |
|---|---|---|---|---|
| 1,937,924 | A * | 12/1933 | Thompson | 206/407 |
| 3,261,460 | A * | 7/1966 | Davis | 206/407 |
| 3,290,861 | A | 12/1966 | Prager | |
| 3,342,014 | A | 9/1967 | Prager | |
| 3,857,486 | A | 12/1974 | Klebanoff, Jr. | |
| 3,863,425 | A | 2/1975 | Edwards et al. | |
| 3,895,711 | A * | 7/1975 | Hiltunen et al. | 206/413 |
| 4,185,742 | A * | 1/1980 | Fisk et al. | 206/414 |
| 4,553,374 | A | 11/1985 | Lancaster et al. | |
| 5,048,261 | A * | 9/1991 | Lancaster et al. | 53/399 |
| 5,533,321 | A | 7/1996 | Hooper et al. | |
| 5,577,366 | A | 11/1996 | Higgins | |

(Continued)

FOREIGN PATENT DOCUMENTS

DE 40 34 757 5/1991

(Continued)

*Primary Examiner*—Mickey Yu
*Assistant Examiner*—Jerrold Johnson
(74) *Attorney, Agent, or Firm*—Katten Muchin Rosenman LLP

(57) ABSTRACT

A package of a roll, particularly a paper web roll comprising a wrapper, particularly a paper web wrapper wound stage-wise into at least two wrappings about the roll in an overlap fashion. The paper web wrapper is wound about the roll in a slightly helical manner so that the edges of the wrapper layers overlap in a staggered fashion. The staggered edges of the overlap wrapping are formed so that each superposed wrapper layer conceals the underlying wrapper layer, whereby in a finished wrapping of a product only one wrapper edge remains visible.

1 Claim, 9 Drawing Sheets

U.S. PATENT DOCUMENTS

Figure 1:
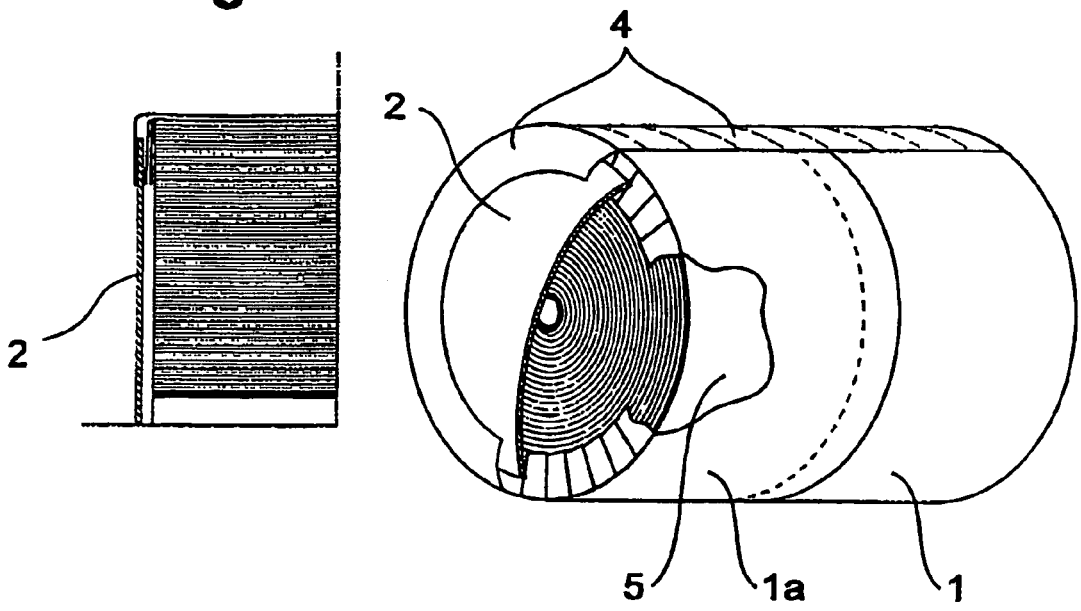

| | | | | |
|---|---|---|---|---|
| 5,765,340 | A | 6/1998 | Ekblom | |
| 5,768,858 | A | 6/1998 | Hannen | |
| 6,186,326 | B1 * | 2/2001 | Pienta et al. | 206/410 |
| 6,347,498 | B1 | 2/2002 | Pienta et al. | |
| 6,446,804 | B1 * | 9/2002 | Lehtineva | 206/394 |
| 6,505,459 | B1 | 1/2003 | Ruohio et al. | |
| 6,813,867 | B1 | 11/2004 | Forsström et al. | |

FOREIGN PATENT DOCUMENTS

| | | | |
|---|---|---|---|
| DE | 41 21 573 | | 1/1993 |
| EP | 0 759 396 | | 2/1997 |
| FI | 83858 | B | 5/1991 |
| FI | 83858 | C | 5/1991 |
| FI | 980093 | | 7/1999 |
| FI | 980510 | | 9/1999 |
| FI | 103958 | | 10/1999 |
| FR | 1 055 390 | | 2/1954 |
| GB | 1 094 805 | | 12/1967 |
| WO | WO 98/49610 | | 12/1997 |
| WO | WO 99/44930 | | 9/1999 |

* cited by examiner

Fig. 6
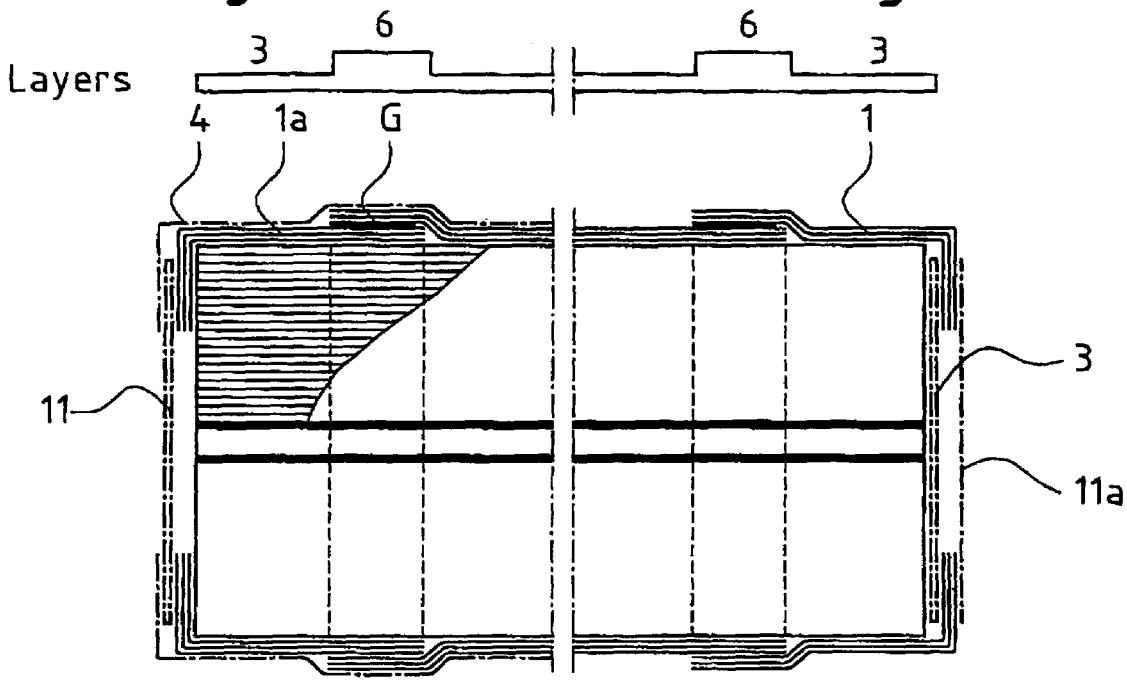
Fig. 6a
Fig. 7
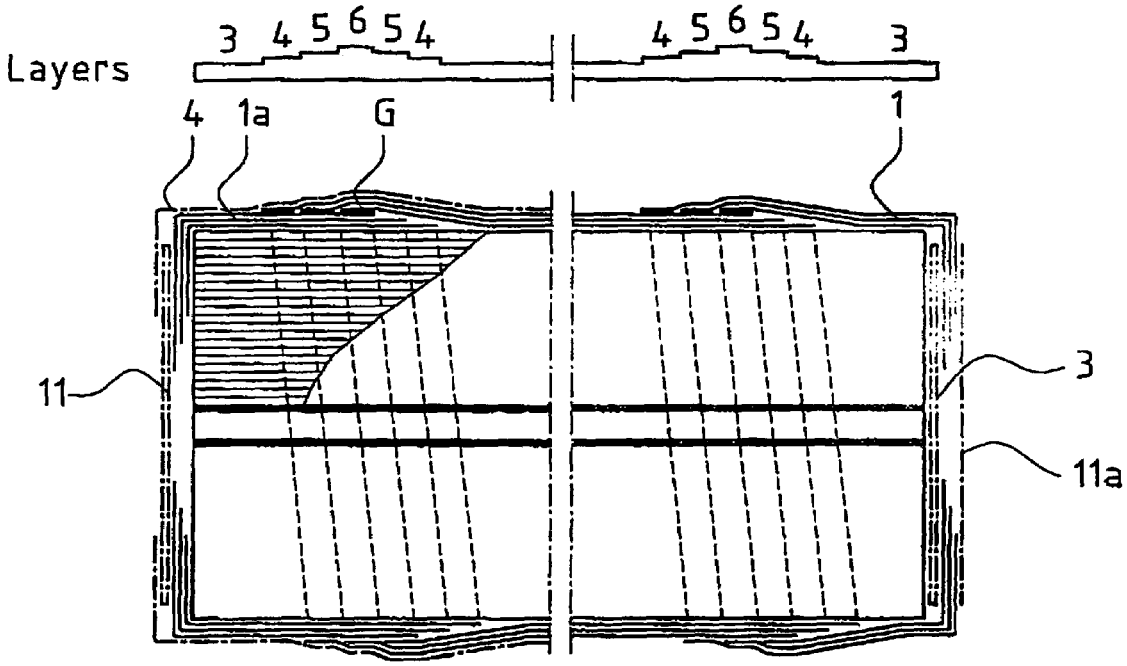
Fig. 7a

Fig. 8
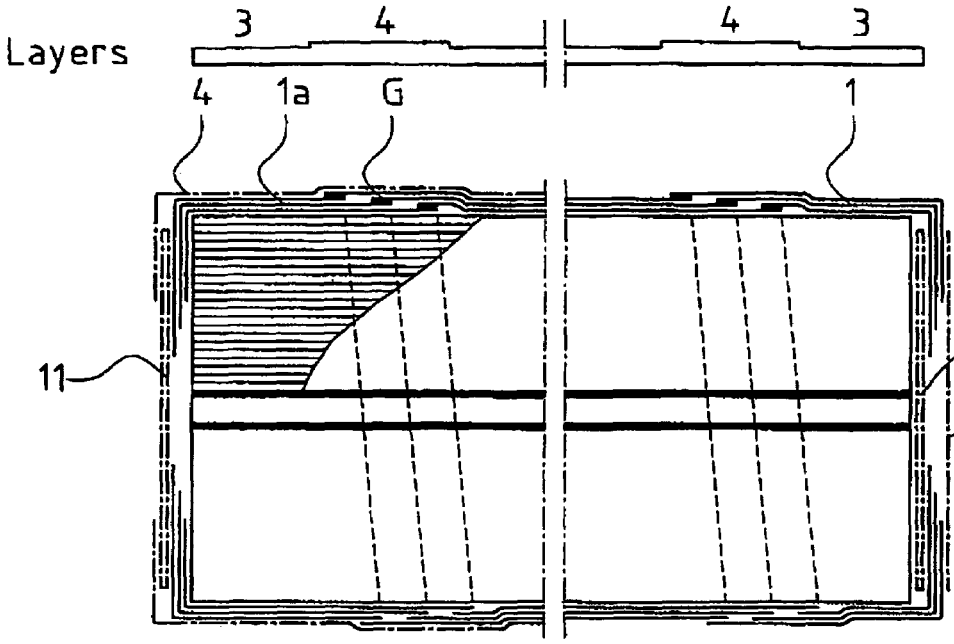
Fig. 8a
Fig. 9
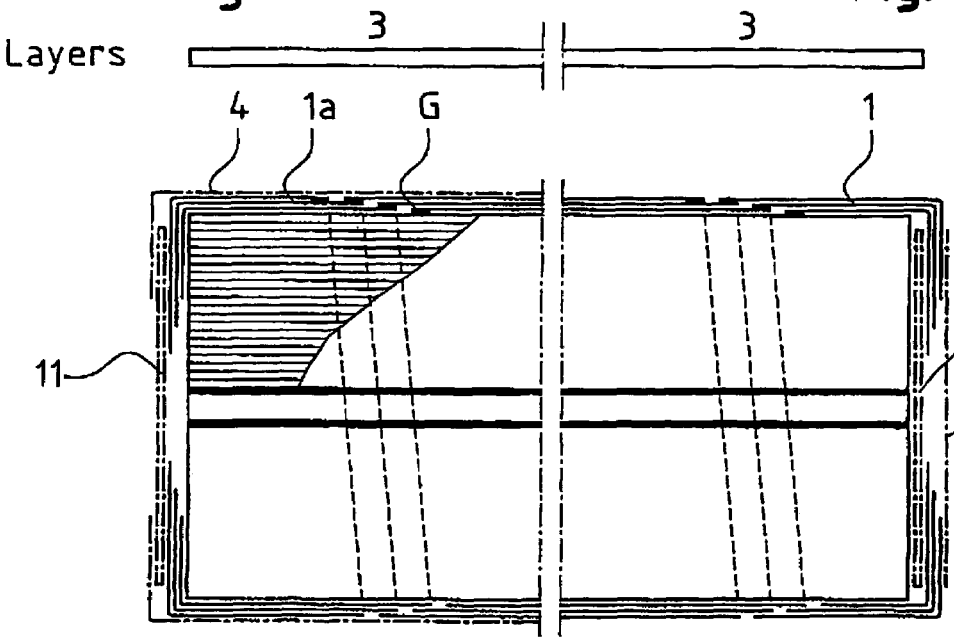
Fig. 9a

ROLL PACKAGE

CROSS-REFERENCE TO RELATED APPLICATION

The present application is a divisional of U.S. patent application Ser. No. 09/933,892 which was filed on Aug. 21, 2001, now pending which is herein incorporated by reference.

The present invention relates to a method according to the preamble of claim 1 for packaging rolls, particularly paper web rolls. Furthermore, the invention relates to an apparatus suited for implementing the method and to a novel type of roll package.

From the prior art is known a roll wrapping method and apparatuses suited for wrapping a roll stagewise using a so-called overlap wrapping technique. This kind of method is disclosed, e.g., in international patent publication PCT/FI97/00322, wherein the roll end is aligned with the edge of the wrapping material web for stagewise wrapping of the roll. In this method and apparatus, the roll is transferred by means of a lift conveyor until the first end of the roll becomes aligned with the first edge of the wrapping material web, whereupon the roll is rotatably supported by a backing roll and then the wrapping is carried out through its different steps. Subsequently, the roll is transferred by a movable conveyor, the other end of the roll is aligned with the other end of the wrapping material web and the wrapper layers are wound about the roll. Alternatively, the alignment operations may be carried out by means of transferring the roll delivering the wrapping material and the slitting device cutting the material in regard to the roll being wrapped. In both embodiments of roll alignment, the roll being wrapped is supported by a support roll that is rotatable in a stationary position.

Another stagewise wrapping method and apparatus is disclosed in FI Pat. Appl. No. 980,093 comprising the steps of bringing the roll to be packaged to a wrapping machine and placing the roll to be packaged on support rolls, rotating the roll to be wrapped on the support rolls and dispensing wrapper about the roll to be wrapped so that at least two wrappings are made parallel to each other and finally securing the wrapper layers to each other at least partially by an adhesive. Among other features, this method is characterized in that the wrapping material is dispensed to each wrapping from the same wrapper roll that is moved in the direction of the longitudinal axis of the roll being packaged. To this end, the apparatus disclosed in the patent application has means for moving the wrapper roll and the wrapper dispensing means laterally along the roll being packaged thus allowing the wrapper to be dispensed onto the roll being packaged so that the roll becomes wrapped by at least two parallel wrappings with the wrapper material. Also this wrapping method utilizes stationary support rolls, and the wrapping station is constructed on a rigid framework.

These prior-art methods and apparatuses are hampered by the disadvantage that if a plant has plural wrapping stations, each one of the wrapping stations need individual lateral transfer means, wrapper dispensing/severing means and, additionally, separate lateral transfer assemblies for the adhesive bonding means. Consequently, the operating and control system of such equipment becomes extremely complicated and costly.

When a combination wrapping comprised of wrappers of different widths is employed, changing the wrapping stations for first applying one wrapping and then another slows down the operation of the wrapping system and thus reduces its capacity.

If the lack of a wrapper of a suitable width in the wrapping station dictates the change of the wrapper roll as may be necessary in the methods disclosed in patent application FI 980,510 and patent publication FI 103,958, the overall performance of the wrapping system is impeded substantially.

In a practicable system, the number of such movable wrapping stations is maximally two which restricts the range of rolls that can be packaged by a single wrapping to small-width rolls only. Consequently, a major portion of rolls produced must be packaged by overlap wrapping, whereby the capacity of the packaging system is reduced. Also the wrapper consumption increases due to the greater need of overlap wrapping.

Conventional stagewise operating wrapping methods are incapable of combining a plastic wrap with the wrapping of a paper wrapper inasmuch the system has only one or two wrapping stations with a construction suitable for handling paper wrapper alone.

As the method and apparatus disclosed in patent application PCT/FI97/00322 requires that roll being packaged is transferred by means of a vertically up and down moving conveyor between the different wrapping steps while the wrapping station is stationary, the system operation becomes clumsy and slow. A further disadvantage of this arrangement is that the support rolls rotating the roll being wrapped must be very long to cope with the axial transfer of the roll being wrapped.

In roll packages made using these prior-art methods, the wrapper edges in a single wrapping coincide with each other thus making the overlap region twice as thick as the rest of the wrapping and producing an abrupt discontinuity in the wrap thereby readily causing compression markings on the roll. Hence, prior-art overlap wrapping methods are not suited for packaging the most sensitive paper webs including self-copying and thermal printer paper grades. Moreover, overlapping wrappings are bonded to each other by only one interlayer bond. Resultingly, such a roll package is not particularly stable in regard to its axial strength which property is requested during lifting rolls in an upright position by means of clamps or straps. Such a roll package made by conventional overlap wrapping techniques is outlined in FIG. 6*a*.

It is an object of the present invention to provide a method and apparatus for packaging rolls using a technique that is free from the above-described disadvantages. Furthermore, the method relates to a novel type of roll package. The method according to the invention is characterized by what is stated in base claim 1.

Specifications of preferred exemplary embodiments of the method according to the invention are disclosed in dependent claims 2–7.

An apparatus suited for implementing the method according to the invention is characterized by what is stated in base claim 8.

Specifications of preferred exemplary embodiments of the apparatus according to the invention are disclosed in dependent claims 9–12.

A roll package according to the invention is characterized by what is stated in base claim 13.

Specifications of preferred exemplary embodiments of the roll package according to the invention are disclosed in dependent claims 14–19.

Figure 13:
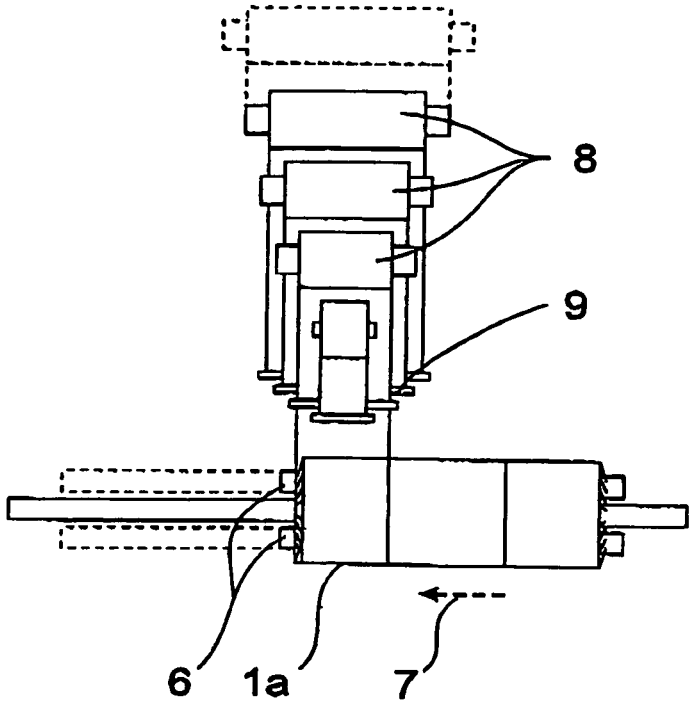
Figure 14:
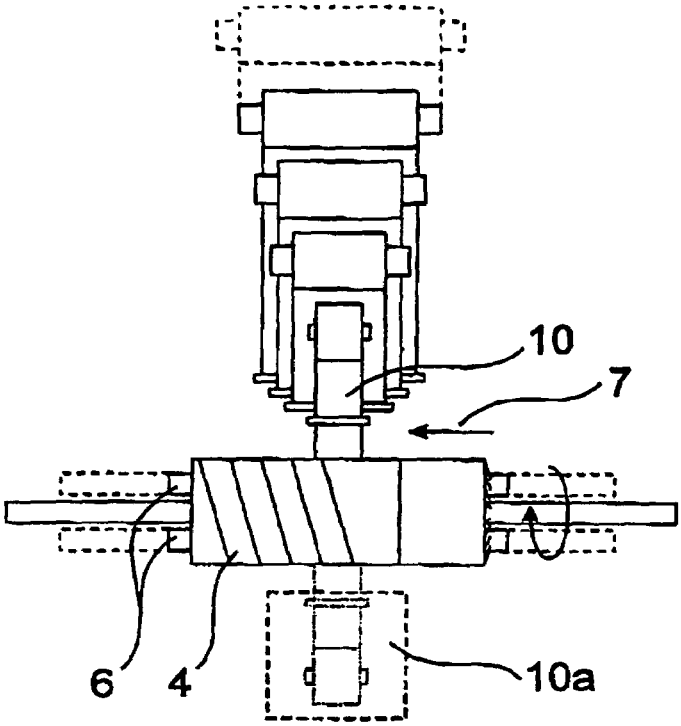
Figure 15:
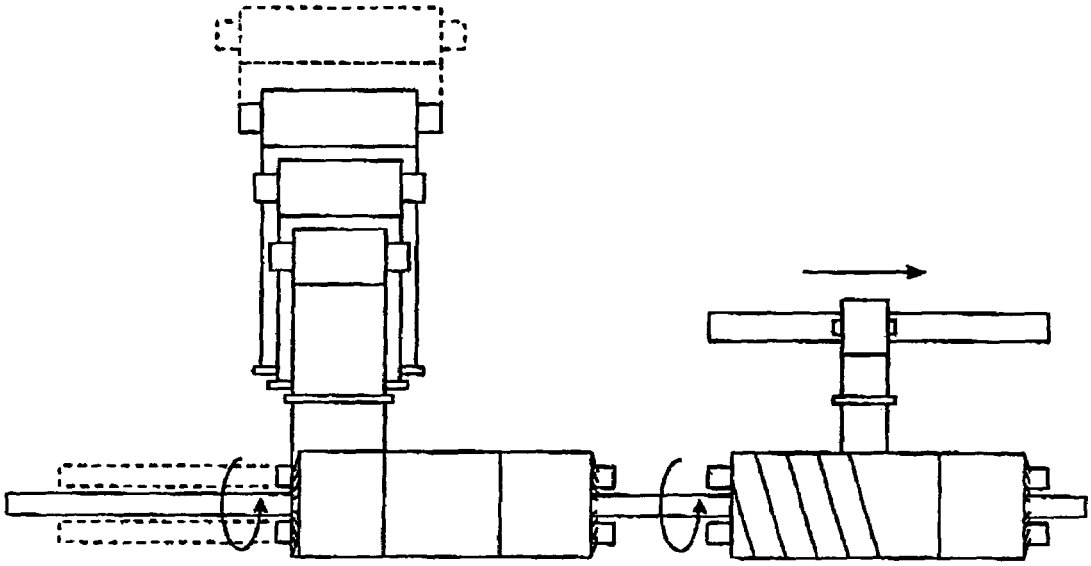

In the following, the invention is described in more detail with reference to the appended drawings in which FIGS. 1–10 show different kinds of roll packages that can be made by means of the method and apparatus according to the invention;

FIGS. 11–14 show an apparatus according to the invention suited for packaging a roll operating in its different packaging steps; and FIG. 15 shows a preferred embodiment of an apparatus according to the invention.

Now referring to FIG. 1, therein is shown a paper roll 5 having a paper wrapper 1, 1*a* wound thereabout with the wrapper edges overextending the end of the roll and then crimped against the roll end. Typically, the package wrap is formed either by one single wrapping extending over the width of the roll or by a greater number of overlapping wrappings 1, 1*a* and typically being selected from the group of conventional packaging materials such as kraftliner, paperboard, cardboard of the like. Generally, the roll is wrapped in multiple layers of paper wrapper that give the required protection to the roll under mechanical handling.

Both ends of the roll are covered by a header 2 placed over the crimped edges of the paper wrapper. Typically, the header is made from corrugated board, fiberboard, a laminate or the like material. The header must be sufficiently stiff and thick to stay in its place. Its major function is to receive the unevenness of transport or storage platforms, such as dents caused by stones and also to eliminate the deleterious compressive effect of wrapper crimps on the roll end. Typically, the header has a polymer, wax or the like coating that forms the necessary moisture barrier at the roll end or, alternatively, the header may be made from an entirely moisture-impervious material. The headers are made to sees matching the diameters of rolls in production. The diameter of a header for a specific package is selected to be equal or slightly smaller than the diameter of the roll end. Typically, the headers are needed in diameters increasing in steps of about 5 cm. The crimped edge of the paper wrapper overlaps the rim of the roll end remaining uncovered by the header.

The paper wrapper is covered by a band-like plastic wrap 4 wound in a helical manner about the roll. The plastic wrap overextends the roll end and, by virtue of tension or heat-shrink, is pulled tightly against the roll end thus keeping the header positively in its place. The plastic wrap gives the roll the required protection from stresses imposed by varying environmental conditions such as moisture, dirt and the like.

Figure 2:
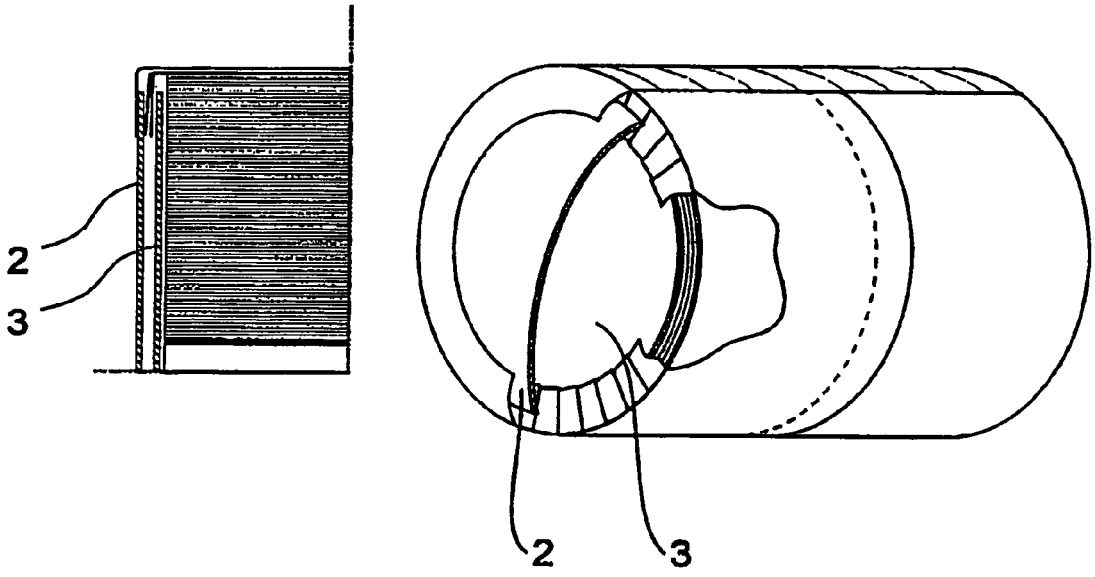

In FIG. 2 is shown a roll package with two headers, an outer header 2 and an inner header 3, the latter being held in place under the crimped edges of the paper wrap. Two headers are inserted on one another when a particularly good protection is desired. In an actual package, two headers are advantageously used only in that end which is intended to face a floor or a platform. Advantageously, the inner and the outer header are identical to avoid an inflated inventory of headers.

Figure 3:
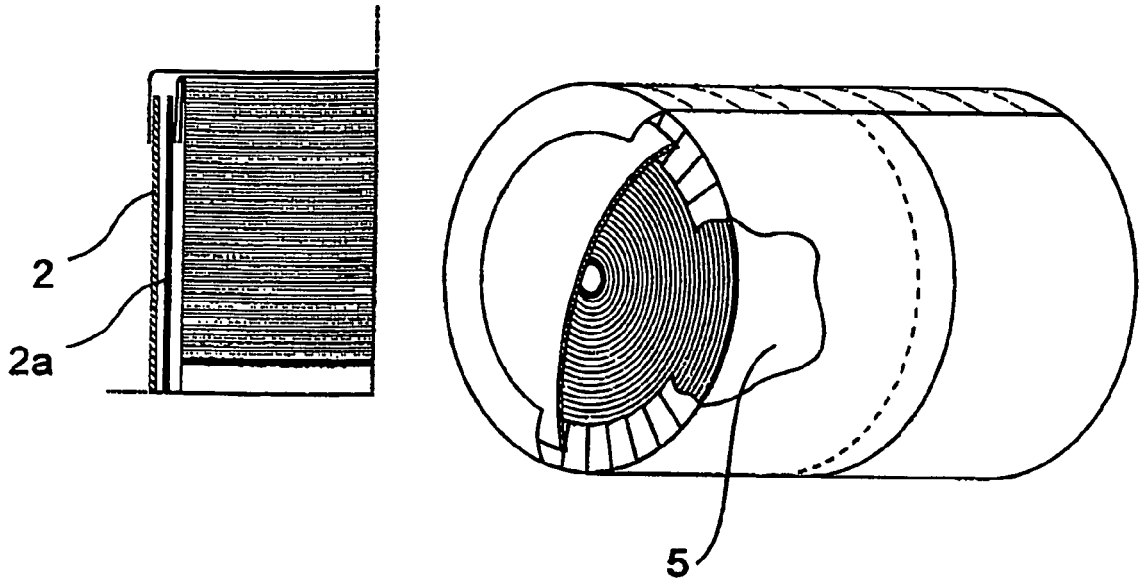

In FIG. 3 is shown a roll end covered by a dual-part header. The outer part 2 of the header structure is thick thus rendering the required mechanical protection and simultaneously keeping the inner part 2*a* in place. For this purpose, the outer part is typically made from conventional corrugated board or the like material. The inner part 2*a* is made from a thin, typically polymer-coated paper or plastic film that acts as the moisture barrier in the roll package. The outer and the inner part of the header structure may be adhered to each other or be separate from each other. The inner part 2*a* may also be located under the crimped edge off the paper wrapper.

Figure 4:
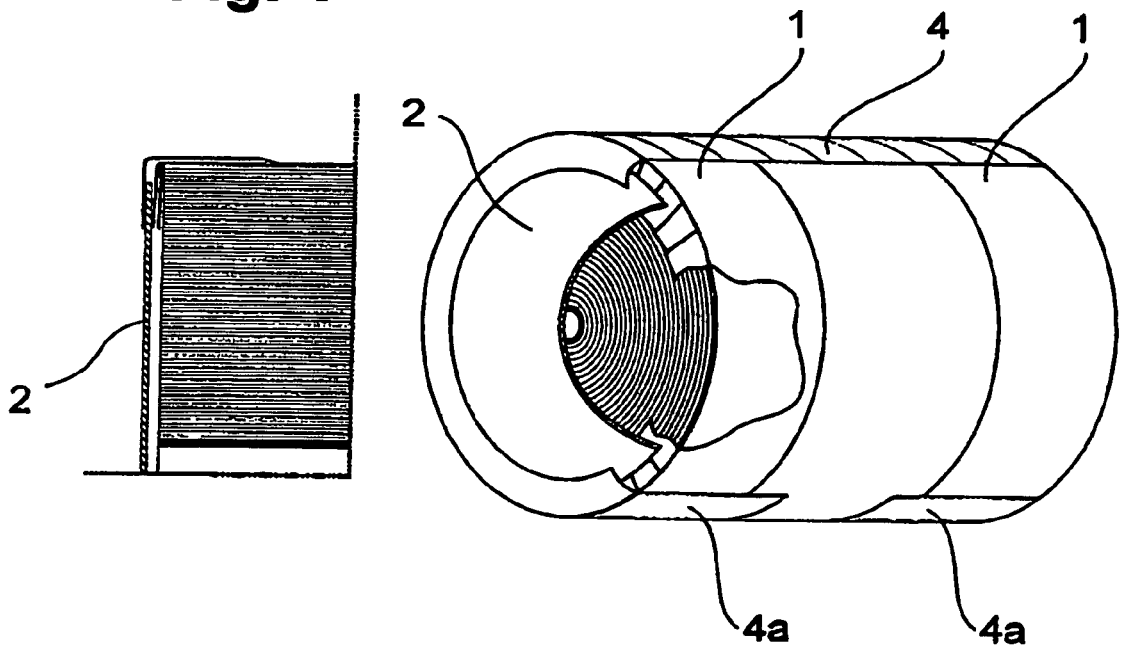

In FIG. 4 is shown a structure wherein only the end portions of the roll are provided with a paper wrapper 1, while the plastic wrap 4 extends over the entire width of the roll (see upper half of FIG. 4). This type of package is used only when the material being packaged is inherently quite strong, such as cardboard, whereby only the end portions of the rolls need to be protected. It is further possible that the plastic wrap 4*a* is wound only about the end portions of the roll (see lower half of FIG. 4).

Figure 5:
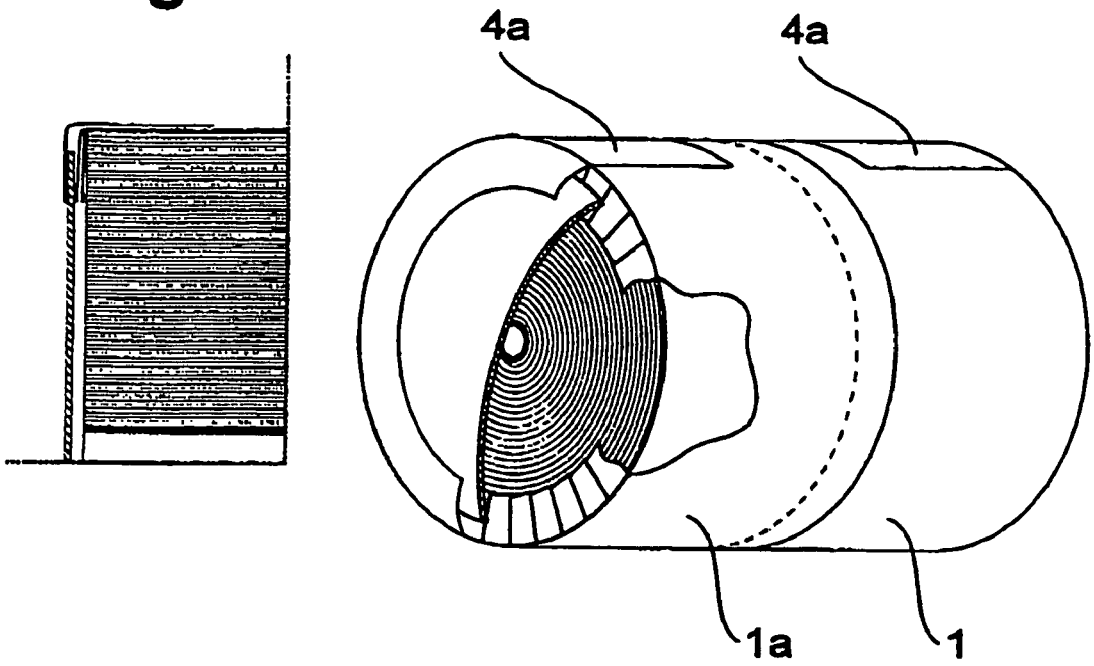

In FIG. 5 the paper wrapper 1, 1*a* is shown overextending the ends of the roll, while the plastic wrap 4*a* is placed on the end portions of the roll alone. Such a combination is used when the protection given by a paper wrapper is sufficient for the outer periphery of the roll, while the roll edges and end need better protection. This wrapping technique is also used when the plastic wrap is only required to keep the headers 2 in place.

Accordingly, the roll package may be varied in regard to the number, quality and location of the headers, and the paper wrapper and plastic wrap may be located in different positions along the package. The above exemplary embodiments were made using the same materials and the same methods and packaging apparatuses as will be described later in the text However, roll packages produced by a given packaging system may individually vary depending on the customer order, product being packaged, transport method and the like factors.

In FIGS. 6, 6*a*–9, 9*a* are shown applications of the overlap paper wrapper 1, 1*a* in a roll package according to the invention. The roll packages shown in FIGS. 7, 7*a*–9, 9*a* have the paper wrapper wound in a slightly helical manner about the roll thus making the wrapper edges to overlap in steps. Herein, the overall thickness of the wrapper changes in steps within the overlap area, see FIGS. 7, 7*a*, whereby the risk of compression markings impressed on the roll periphery by bulges in the wrapper thickness is reduced. This technique overcomes the problems hampering roll packages produced by conventional overlap wrapping, see FIG. 6*a*. The steps on the roll periphery formed by the wrapper edges are advantageously staggered so that the step of the next upper wrapper layer always conceals that formed by the next below. Resultingly, only one wrapper edge remains visible in the overlap wrapping.

The sharp edges of superposed wrapper layers may overlap partially or coincide entirely whereby this technique reduces the overall extra thickness of the wrapper as illustrated in FIGS. 8, 8*a* or, alternatively, leaves not extra thickness at all, see FIGS. 9, 9*a*. The latter type of roll packaging technique is advantageously used in conjunction with a plastic wrap, see FIG. 9, particularly when no extra bulges on the wrapper periphery are allowed at all, as is the case in the packaging of a self-copying paper grade, for instance.

For the above-described roll package that is wound in a slightly helical manner, it is advantageous to select the wrapper width so that the sharp edge of the wrapper close to the roll end becomes entirely concealed or at least the topmost layer of the wrapper is placed about the roll end so that its edge remains invisible. This arrangement offers the benefit that the roll edge is protected by the full number of wrapper layers, while the number of wrapper layers is diminished closer to the center axis of the roll end and the thickness of wrapper crimps is reduced thus making the packaging operations easier to perform. The outermost overextending wrapper edge may reach almost to the center of the roll without causing any problems to the crimping of the wrapper edge or in the insertion of headers on the roll end.

Roll packages may also be wound without using the plastic wrap 4. Then, the wrapper material is typically selected to be a so-called laminate wrapper, or even a more conventional packaging material can be used if the protection given thereby is sufficiently good in a general sense. Herein, the headers are adhered onto the crimped edges of the wrapper in a conventional manner by gluing or hot-melt sealing.

Figure 11:
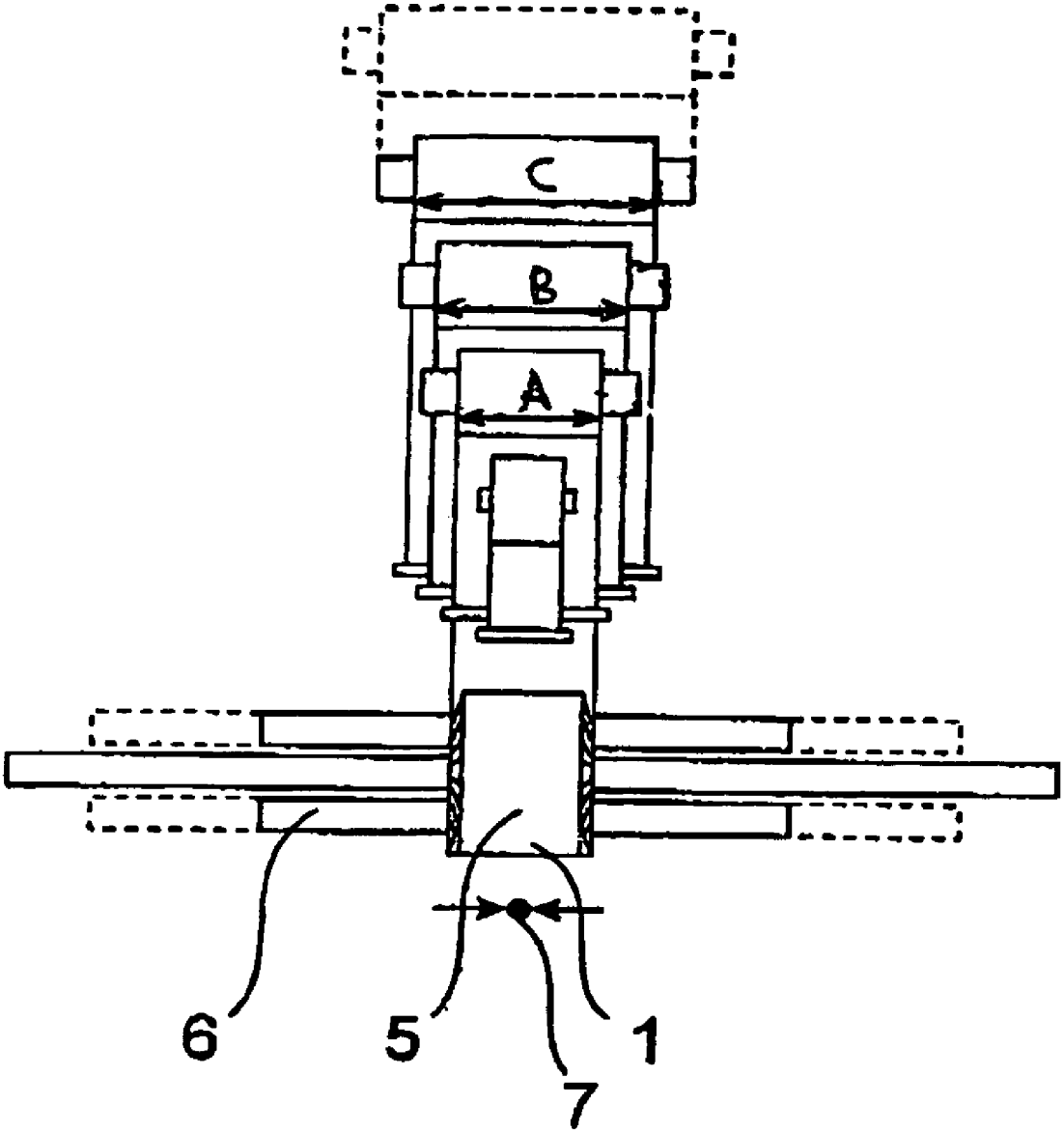

In an overlap wrapping application of the roll package according to the invention, there are used two or a greater number of parallel wrappings depending on the available width selection of wrappers. Advantageously, four different widths of wrappers are used with widths increasing in steps of 200 mm or 300 mm. In FIG. 11, for instance, the wrapper widths may be A=1000 mm, B=1250 mm and C=1500 mm. Then, customer rolls in the width range 500 to 1300 mm are packaged in a single wrapping, while rolls wider than those are packaged in an overlap wrapping. Then, the overlap wrapping combinations used for different widths of customer rolls can be, e.g., A+A up to roll widths of 1700 mm, A+B up to 1950 mm, B+B up to 2200 mm, B+C up to 2450 mm, C+C up to 2700 mm, etc. Rolls of 4200 mm maximum width can be wrapped using wrapper combination C+C+C. As is evident from these examples, the roll packages according to the invention cover a large range of roll widths using a minimal number of paper wrapper widths.

By virtue of using a staggered overlap of the wrapper layers, the overlap areas can be wound with a smaller degree of overlap between the wrapper layers and yet achieving a wider contact area at the overlap areas of the staggered paper wrap layers than that offered by the prior art. Advantageously, each wrapper layer is in contact with and bonded (G) to the equivalent wrapper layer of the closest parallel wrapping, see FIGS. 8, 8*a*. In this fashion the overlap bonding of the package wrapper becomes strong, which is an important requirement for safe handling of rolls in their upright position. The heavier the roll the more important is the bond strength of the overlap seam. Owing to its smaller overall overlap need, the novel packaging method can use a smaller amount of wrapper per roll as compared to conventional overlap-wrapped packages.

The wrapper layers are bonded to each other by means of conventional gluing methods and equipment. Alternative bonding techniques include melting and heat-sealing of an adhesive layer applied to the wrapper.

Figure 10:
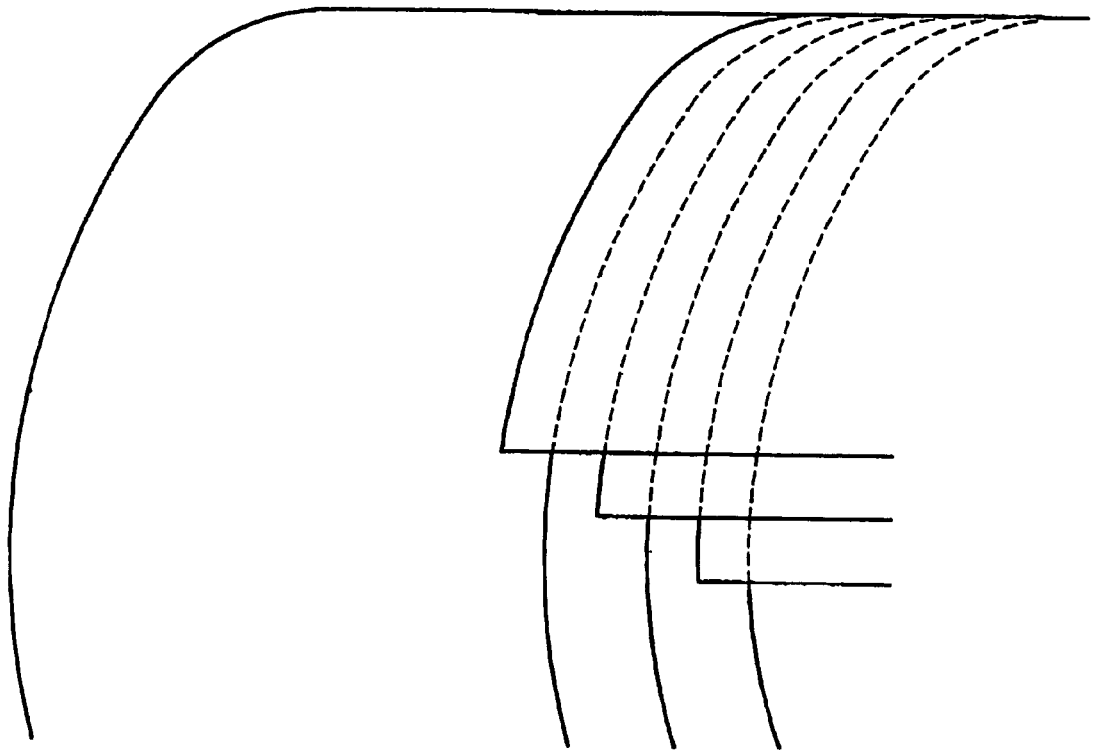

In FIG. 10 is shown a preferred overlapping technique of the wrapper layers in a cross-sectional view.

In FIG. 11 is shown the winding of a paper wrapper about a roll 5, when the wrapping is made centrally on the roll using a single wrapper 1 having a width extending over the entire width of the roll being wrapped. The roll is aligned centrally in regard to the wrapper being wound by means of transferring the wrapping station laterally if necessary and then crimping both edges of the wrapper against the roll ends. This so-called centrally aligned wrapping technique is carried out using a single wrappings whereby a short cycle time and high wrapping capacity is attained. In terms of wrapping throughput, these features are crucial, because the number of customer rolls produced by a plant is inversely proportional to the size of the customer rolls if the production volume in tons is assumed to be constant.

Figure 12:
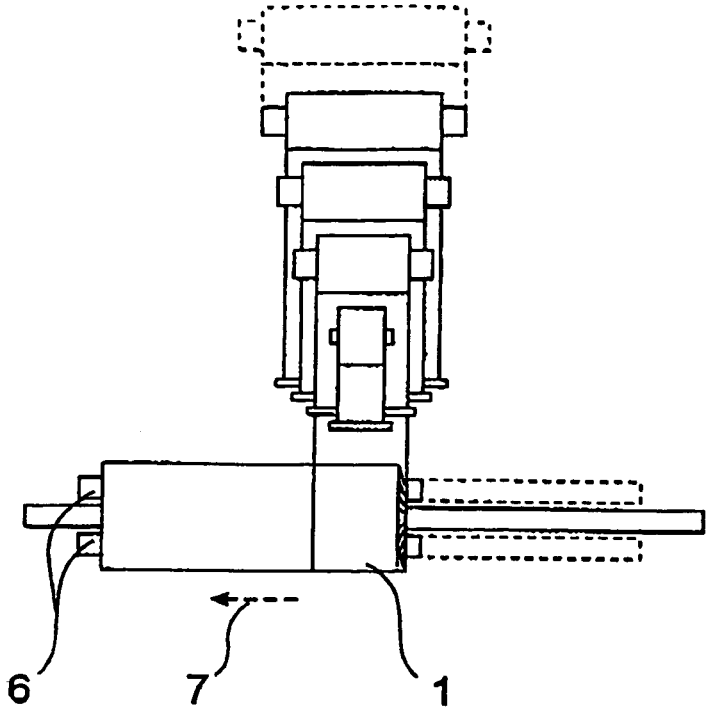

FIGS. 12 and 13 show stagewise wrapping of a wide roll with a paper wrap. Herein, FIG. 12 shows the first stage of overlap wrapping, wherein the respectively first edge of the paper wrap 1 is crimped against the roll end, while FIG. 13 shows correspondingly the wrapping of the wrapper 1*a* in the last stage of the wrapping operation.

The wrapper combination to be selected for any particular roll is optimized based on the width of the roll to be wrapped and the widths of the available wrappers. The roll is aligned laterally in the different wrapping stages by transferring the wrapping station 6 in the direction of the roll axis, see FIGS. 12 and 13. The paper wrapper storage stations 8 and the wrapper feed and gluing apparatuses 9 are stationary.

When the overlap wrapping is made as shown in FIGS. 7, 7*a*–9, 9*a* in order to obtain a staggered wrap, the wrapping station 6 is transferred laterally in the roll axis direction 7 during the wrapping operation. The axial transfer and the feed rate of paper wrapper is controlled appropriately according to the roll diameter, desired stagger rate and overall degree of overlap. Also in this embodiment, the storage stations 8 and the wrapper feed/severing apparatuses 9 are stationary. The leading end of the paper wrapper can be introduced in a slightly oblique direction onto the roll being wrapped or, alternatively, the leading end of the wrapper can be gradually askewed during the initial stage of wrapping in order to obtain the desired degree of staggered overlap. The wrapping station and the wrapper feed apparatus may also be located in an askewed disposition with each other to achieve a desired degree of staggered overlap in the wrapping.

When the overlap wrapping is made to obtain the wrap shown in FIGS. 6, 6*a*, the roll is not moved laterally during wrapping. Also in this embodiment, the apparatus according to the invention is used during the different wrapping stages for aligning the roll laterally.

Conventional methods and techniques are used to implement the feed, edge crimping and severing of the paper wrapper. The import of the roll to the wrapping station and export therefrom take place in a conventional manner either by transferring the roll axially with the help of a conveyor or carriage or, alternatively, by pushing the roll radially, or by a combination of these.

FIG. 14 shows an apparatus suitable for wrapping a package according to the invention when the wrapping of a plastic wrap 10 takes place in the same wrapping station with the wrapping of the paper wrapper. Herein, the axial movement in regard to the roll being wound is performed by transferring the wrapping station and simultaneously rotating the roll being wound, whereby the plastic wrap is wound in a helical manner about the roll.

The wrapping assembly 10 of the plastic wrap is advantageously associated with paper wrapper feed unit 9, whereby it is possible to use for the wrapping of the plastic wrap the same wrapper feed, gluing, severing, and header insertion, etc. means as are employed for wrapping the paper wrap. As such devices are known to those versed in the art, their detailed description may be omitted herein.

It is also possible to use a separate assembly 10*a* for wrapping the plastic wrap, whereby the assembly is located on the opposite side of the wrapping station 6 in regard to the paper wrap handling means 8, 9. The plastic wrap dispensing assembly may also be located above the wrapper apparatus.

The insertion of headers may be carried out in a conventional manner either manually or in an automated manner. One type of such method and apparatus is disclosed in FI laid-open publication 95,228. As the inner header is identical with the outer header, the number of different headers is thus minimized optimally and the insertion of headers is easy to automate.

All the roll package variations shown in FIGS. 1–9 can be accomplished by means of the method and apparatus according to the invention.

The method and apparatus according to the invention may also be employed for wrapping a so-called lightweight package comprising only a plastic wrap and a header in both ends or only one of the roll. This packaging technique is used when the need for roll protection is relaxed as is the case, e.g., in the internal storaging of a production plant.

When a roll packaging system is required to offer a capacity higher than that achievable by means of single combination paper wrapper-plastic wrap dispensing station or other reasons so indicate, the paper wrapper can be wound using the method and apparatus according to the invention, while the plastic wrap is applied separately by means of a conventional technique known as the radial winding method. In such an arrangement, the different wrapper winding steps are arranged to take place in separate stations, see FIG. 15, in order to facilitate parallel operation of the winding apparatuses. Hereby, the cycle time in the operation of each wrapping station is reduced and, respectively, its capacity increased.

The method and apparatus according to the invention may also be utilized so that the roll is protected by a paper wrapper only, see FIGS. 6*a*, 7*a*, 8*a*. 9*a* and 11, 12, 13, whereby the plastic wrap is omitted. In such a package, the headers are adhered in a separate packaging step by means of gluing or hot-sealing to the wrapper edges that are crimped over the roll ends. The wrapper used herein may be either a conventional paper wrapper or a so-called laminate wrapper.

In a roll packaging system based on the apparatus according to the invention, the wrapper storage stations and wrapper dispensing means are stationary, but the wrapping station is adapted movable in the axial direction of the roll. Herein, the roll packaging system may handle the wrapping operations with the help of one transfer function only that provides all the required wrapping combinations and packaging variations. Such a system is simpler and less costly to implement than other overlap wrapping system known to date in the art. When an overlap wrapping system operating with multiple widths of wrapper is used, the change to a different wrapper width does not impede the operation of the system inasmuch all wrappers are ready for dispensing in the wrapper feed unit. Only the roll to be wrapped is transferred during and/or between the different wrapping stages.

A roll packaging system equipped with the apparatus according to the invention is not limited as to the number of wrapping stations. Typically, the number of different wrapper widths is three or four, whereby an extensive range of the rolls of different widths can be packaged centrally aligned to a single wrapper thus permitting a major portion of roll production to be packaged by the central packaging technique, see FIG. 11. Then, only the widest rolls need to be wrapped by the overlap wrapping technique, see FIGS. 12–15. However, this presents no limiting bottleneck to the production of the plant manufacturing the rolls, because the number of roll sets slit from the flow of machine rolls is independent from the widths of the individual customer rolls. Hence, a roll packaging system equipped with the apparatus according to the invention offers an improved capacity over prior-art overlap wrapping techniques.

The method according to the invention and the apparatus implemented based thereupon can be utilized to construct a so-called universal wrapping system that fulfills varying needs in the art of roll packaging, whereby the roll packages made using the system can be varied individually according to the requirements set by the customer, product, type of transport, etc.

To a person skilled in the art it is obvious that the invention is not limited by the above-described exemplifying embodiments, but rather may be varied within the inventive spirit and scope of the appended claims.

What is claimed is:

1. Package of a roll, particularly a paper web roll, comprising a wrapper, particularly a paper web wrapper wound stagewise into at least two wrappings about the roll in an overlap fashion, characterized in that the paper web wrapper is wound about the roll in a slightly helical manner so that the edges of the wrapper layers overlap in a staggered fashion, wherein the staggered edges of the overlap wrapping are formed so that each superposed wrapper layer conceals the underlying wrapper layer, whereby in a finished wrapping of a product only one wrapper edge remains visible on a cylindrical surface of the paper web roll.

* * * * *